US005505645A

United States Patent [19]

Engler, Jr.

[11] Patent Number: 5,505,645

[45] Date of Patent: Apr. 9, 1996

[54] FLOATABLE ASSEMBLY FOR SWIMMING POOLS

[75] Inventor: Don T. Engler, Jr., Phoenix, Ariz.

[73] Assignee: E D F Products, Inc., Phoenix, Ariz.

[21] Appl. No.: 345,248

[22] Filed: Nov. 28, 1994

[51] Int. Cl.[6] ..... A45B 23/00

[52] U.S. Cl. ..... 441/1; 135/16; 472/128

[58] Field of Search ..... 135/15.1, 16; 472/128, 472/129; 441/1, 28, 29, 30, 35, 38, 22

[56] References Cited

U.S. PATENT DOCUMENTS

| | | | |
|---|---|---|---|
| 2,163,795 | 6/1939 | Merralls | 441/30 |
| 3,434,484 | 3/1969 | Dilullo | 135/16 |
| 3,656,749 | 4/1972 | Reyes | 441/1 |
| 3,953,029 | 4/1976 | Boyd | 472/128 |
| 4,669,989 | 6/1987 | Havlick | 441/1 |
| 5,299,588 | 4/1994 | MacLeod | 441/130 |
| 5,339,847 | 8/1994 | Kanter et al. | 135/16 |

*Primary Examiner*—Stephen Avila
*Attorney, Agent, or Firm*—Cahill, Sutton & Thomas

[57] ABSTRACT

An assembly is provided which includes a generally upright, substantially rigid pole having upper and lower ends. A weight is connected to the lower end of the pole. A float surrounding the pole intermediate the ends of the latter is connected to the pole by a universal coupling which permits the float to move with wave action while the pole remains substantially stationary. The upper end of the pole may carry a sunshade or game apparatus.

10 Claims, 3 Drawing Sheets

FLOATABLE ASSEMBLY FOR SWIMMING POOLS

TECHNICAL FIELD

This invention is concerned with enhancing the recreational usage of swimming pools.

BACKGROUND ART

The desirability of providing a floating sunshade in an outdoor swimming pool for the comfort of users of the pool has been recognized by others. For example, Donna R. MacLeod in her U.S. Pat. No. 5,299,588, granted Apr. 5, 1994, for "FLOATABLE SUNSHADE ASSEMBLY" discloses several embodiments of sunshades for this purpose.

In each of her embodiments, MacLeod mounts the sunshade rigidly on the float component of the assembly. As a result, the sunshade moves about erratically when the float moves with wave action in the pool.

MacLeod further envisioned the use of the float portion of the assembly as a receptacle for beverage containers and loose items, such as sunglasses and suntan lotion containers. But, again, wave action on the float interferes with use of the float as a receptacle.

There continues to be a need for an assembly which affords stability for articles associated with the assembly, such as a sunshade, a beverage tray or game apparatus.

DISCLOSURE OF THE INVENTION

This invention envisions an assembly comprising a generally upright, substantially rigid pole which extends down through a float to a stabilizing weight attached to the lower end of the pole. A pivotal connection between the float and the pole provides for universal tilting movement of the float with respect to the pole. Thus, wave action on the pool surface causing movement of the float does not disturb the position of the pole and articles associated with the pole.

The invention also contemplates the provision of a sunshade connected to the pole at its upper end and a beverage tray connected to the pole above the float so the sunshade and the tray are stable, notwithstanding tilting movement of the float.

The invention further contemplates mounting game apparatus on the pole.

BRIEF DESCRIPTION OF THE DRAWINGS

The invention is described in greater detail hereinafter by reference to the accompanying drawings, wherein.

BEST MODES FOR CARRYING OUT THE INVENTION

Figure 1:
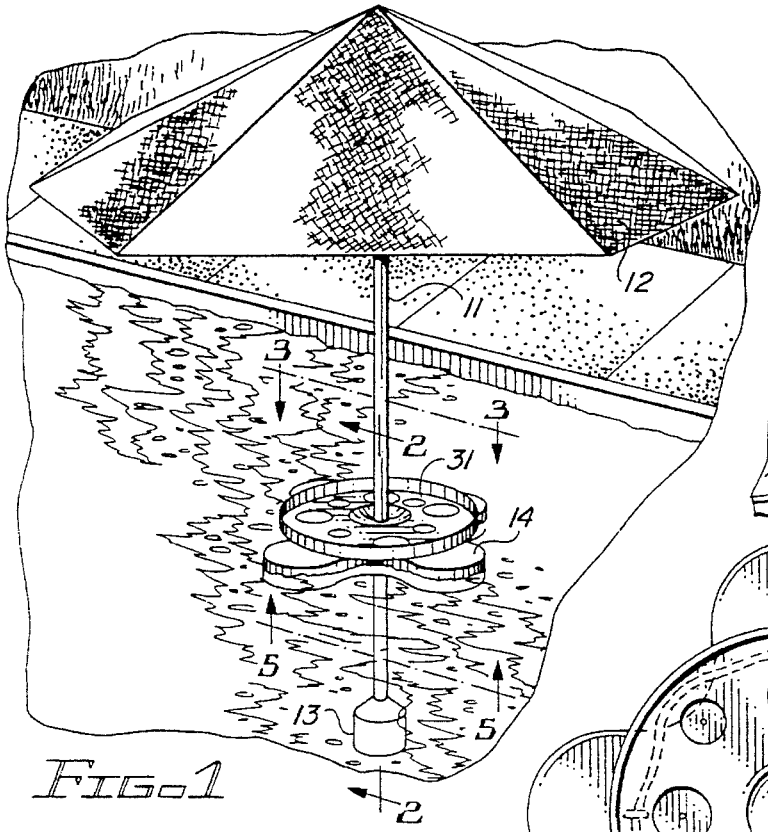
FIG. 1 is a perspective view of the sunshade assembly of this invention, shown floating in a swimming pool and supporting a sunshade and a beverage tray.
Figure 4:
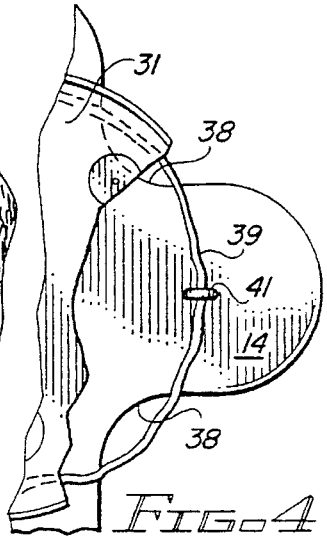
FIG. 4 is a fragmentary view similar to FIG. 3 with portions broken away to show a handling rope for the assembly.
Figure 3:
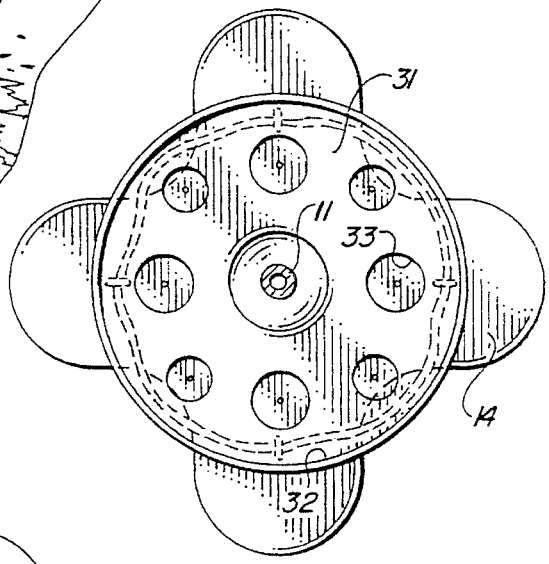
FIG. 3 is a horizontal sectional view taken generally as indicated by line 3—3 in FIG. 1.

Referring particularly to FIG. 1, the assembly of this embodiment of the invention comprises four principal components, namely, a generally upright, rigid pole 11, a sunshade 12 carried by the upper end of the pole, a stabilizing weight 13 affixed to the lower end of the pole, and a float 14 surrounding an intermediate region of the pole.

Pole 11 is preferably formed of metal tubing and may have telescoping sections for purposes hereinafter described. Sunshade 12 is preferably of the collapsible type commonly used to shade circular outdoor tables. Construction of the sunshade 12 is conventional and well understood with a fabric or plastic cover supported by radially extending movable ribs (not shown).

Float 14 is preferably fabricated from a closed-pore, cellular material such as expanded polystyrene or foamed polyurethane. If desired, the outer surface of the float 14 may be provided with a waterproof coating to resist water penetration.

Figures 2, 7, 8, 9:
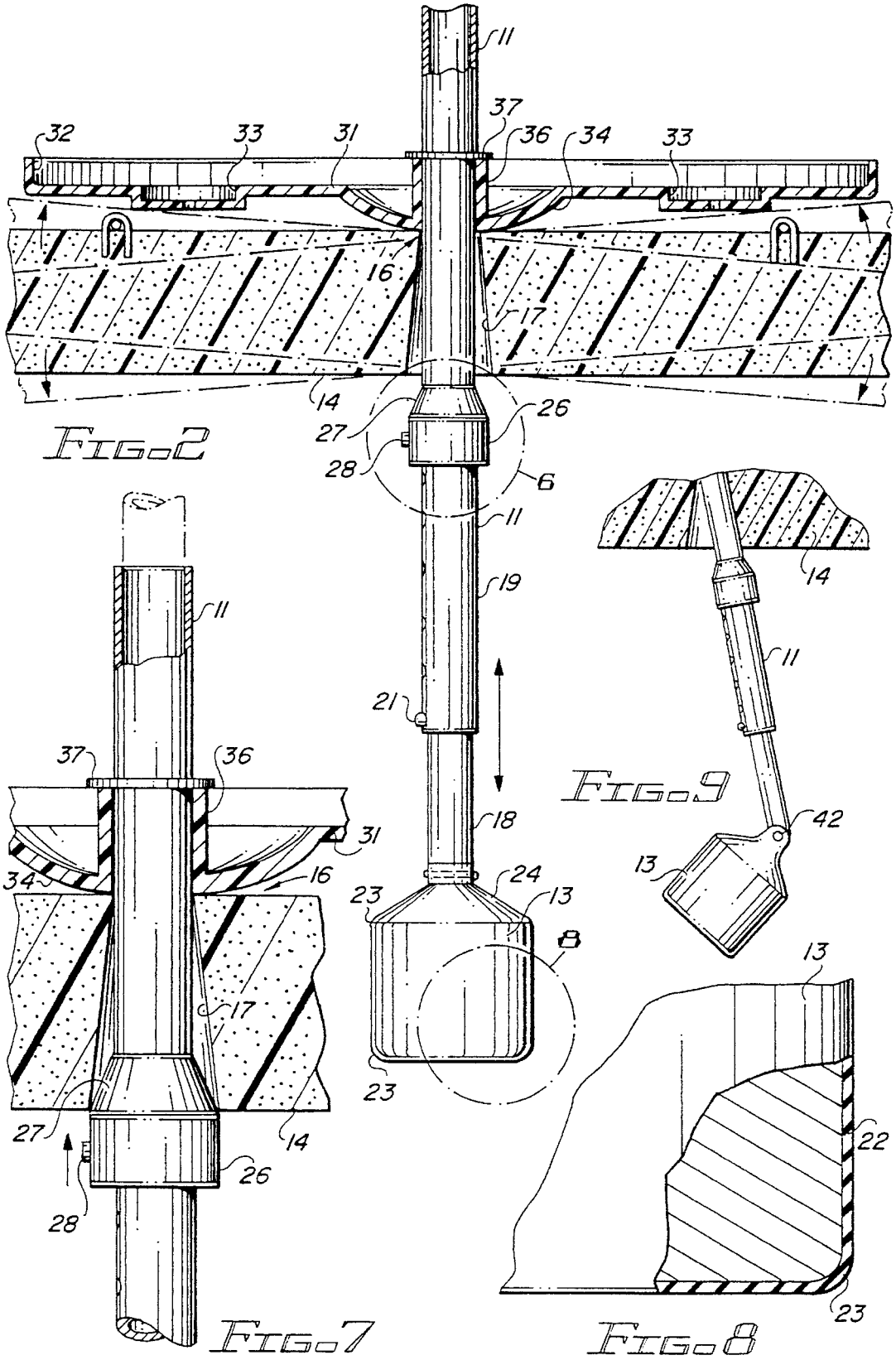
FIG. 2 is a vertical sectional view through the assembly taken generally as indicated by line 2—2 in FIG. 1.
FIG. 7 is an enlarged sectional view through the stability adjustment mechanism shown in FIGS. 2 and 6.
FIG. 8 is an enlarged fragmentary view of a weight employed in the assembly; this view is of the region within circle 8 in FIG. 2.
FIG. 9 is an elevational view illustrating a weight position adjustment feature of the invention.

Float 14 loosely surrounds pole 11 and the pole is positioned on the float by a universal pivotal connection indicated generally by reference numeral 16 in FIGS. 2 and 7. The opening 17 in a central region of float 14 through which pole 11 passes is tapered, i.e., flared outwardly and downwardly as shown in those figures. The combination of the universal pivotal connection 16 and the tapered opening 17 permits the float 14 to move and tilt under wave action while the pole 11 remains substantially upright. See the arrows and dot and dash outlines of the float 14 in FIG. 2.

Pole 11 and sunshade 12 thereon remain substantially upright because of the force from stabilizer weight 13 acting downwardly on pole 11. The farther below the pivotal connection 16 the weight 13 is located, the greater the moment of inertia exerted by the weight 13 to hold pole 11 and sunshade 12 upright. The pole 11 may, if desired, be provided with a lower section 18 which slidingly telescopes within an intermediate section 19 of the pole to permit the position of the weight relative the connection 16 to be adjusted. A stop button 21 on the lower pole section 18 provides for adjustably locking the lower pole section in different positions relative the intermediate section 19.

When the sunshade assembly is installed in deep water, the weight 13 is preferably lowered to a maximum distance below the pivotal connection 16 with float 14. When the assembly is used in shallow water, the weight 13 may be raised so that it does not contact the pool bottom.

Figure 5:
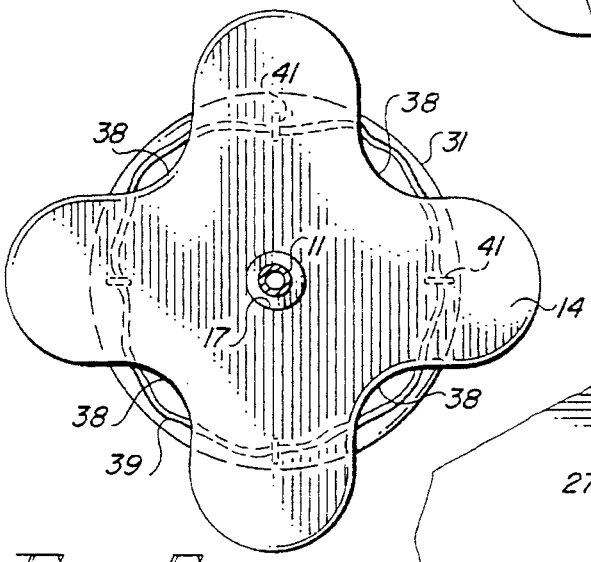
FIG. 5 is a horizontal sectional view taken generally as indicated by line 5—5 in FIG. 1.
Figure 6:
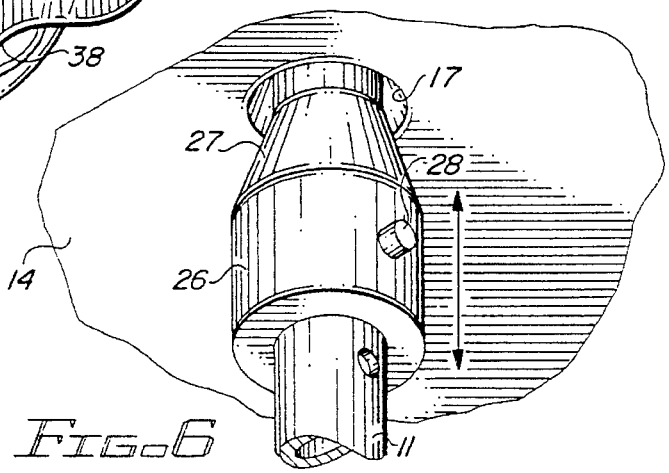
FIG. 6 is an enlarged perspective view of a stability adjusting collar; this view is of the region within circle 6 in FIG. 2.

Weight 13 is preferably made from heavy metal coated with a soft, rubber-like coating 22 (FIG. 5) to prevent injury to a swimmer who comes into contact with the weight. In addition, the weight 13 is preferably cylindrical in configuration with rounded corners 23 and a tapered neck 24 to allow cleaning appliances in the pool to pass smoothly around and over the weight.

Under certain conditions, it may be desirable to limit the relative tilting motion between the float 14 and the pole 11. This is especially true when high winds occur which tend to blow the sunshade 12 over. The pole 11 has a stability adjusting collar 26 slidingly positioned therein just beneath the lower surface of float 14. Collar 26 has a tapered upper surface 27 which is adapted to enter the lower end of float opening 17. Depending upon the extent to which collar surface 27 is moved into float opening 17, relative tilting movement between the float 14 and the pole 11 is either limited or entirely prevented (see FIG. 7). A set screw 28 in the body of the collar 26 maintains the collar in the position selected by the user of the assembly.

Optionally, the sunshade assembly may include a beverage tray 31 carried by pole 11 just above float 14. The beverage tray 31 is preferably molded or vacuum formed from a dense plastic material to a circular configuration with an upstanding outer rim 32. The tray 31 may also have recesses 33 formed therein for receiving and holding beverage containers.

In accordance with this invention, the beverage tray 31 may be configured to provide the universal pivotal connection 16 between the float 14 and the pole 11. As best shown in FIGS. 2 and 7, the central region of tray 31 may have formed therein a downwardly projecting semi-spherical protuberance 34 adapted to contact the upper surface of float 14. An upwardly projecting sleeve 36 formed in the center of tray 31 grips pole 11 and abuts a collar 37 affixed to the pole and transmits the weight of the pole 11, the sunshade 12 and the weight 13 to the float 14. The semi-spherical protuberance 34 on the underside of the tray 31 acts as a bearing to permit universal tilting motion of the float relative to the pole 11. Of course, a similar universal connection could be provided apart from or without the beverage tray 31, as described hereinafter.

If the beverage tray 31 is included in the assembly, then it is desirable to configure the plane of the float 14 in a cruciform or other configuration to provide reduced diameter regions 38 in the float to permit a swimmer to approach and have access to the beverage tray.

Another optional feature of the sunshade assembly of this invention is a loop of handling rope 39 laid across the top surface of float 14. The rope 39 may be affixed to the float at intervals by suitable means, such as staples 41. Rope 39 may be grasped and pulled to move the sunshade assembly from one location to another or enable a swimmer to hold himself or herself beneath the sunshade 12.

Another optional feature which may be incorporated into the assembly is an adjustable connection 42 between weight 13 and pole 11 (see FIG. 9). The adjustable connection 42 permits the centroid of the weight 13 to be swung out of alignment with the axis of pole 11. Because the centroid of the weight 13 will gravitate to a position directly beneath the pivotal connection 16 between pole 11 and the float 14 when the weight is moved out of alignment with the pole, a cant or tilt is imparted to the pole, causing the sunshade to tilt to one side. This positioning of the sunshade may be desirable when the sun is lower to the horizon and directing its rays at a shallow angle to the pool.

Figure 10:
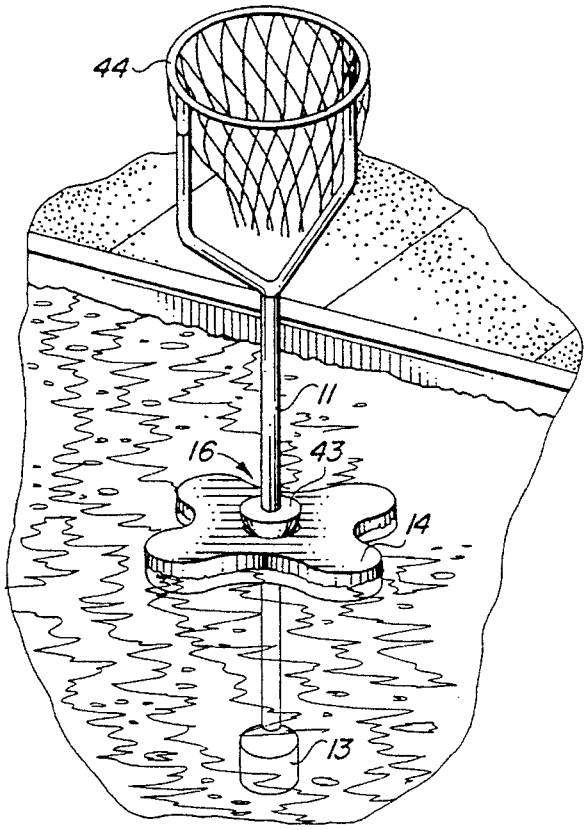
FIG. 10 is a perspective view of the assembly holding a basketball game hoop.

FIG. 10 illustrates the floatable assembly being employed to support and position a game apparatus. Again, the assembly comprises a generally upright rigid pole 11, a weight 13 connected to the lower end of the pole, and a float 14 loosely surrounding an intermediate section of the pole.

A universal pivotal connection 16 is provided in this assembly by a collar 43 affixed to the pole 11. The collar 43 has a semi-spherical lower surface for contacting the top surface of the float 14.

Carried at the upper end of pole 11 is a basketball hoop 44. The assembly is capable of supporting the basketball hoop in a fairly stable position, notwithstanding wave action on the float 14.

Figure 11:
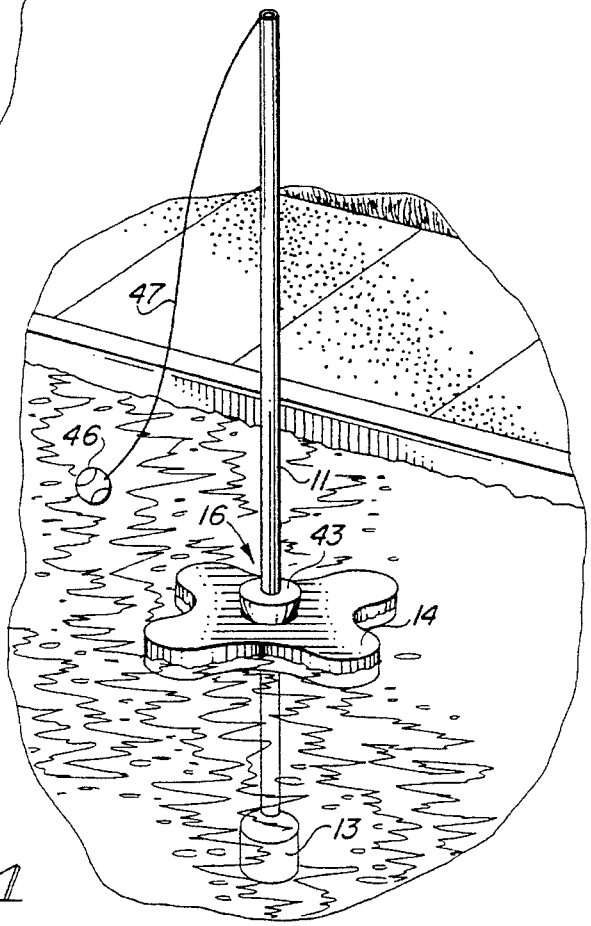
FIG. 11 is a perspective view of the assembly supporting a tether tennis game ball.

FIG. 11 illustrates the floatable assembly being employed to support a ball 46 from a tether 47 connected to the upper end of pole 11. This assembly is used in playing the game of tetherball.

From the foregoing, it should be apparent that this invention provides a sunshade assembly with a variety of advantageous features.

What is claimed is:

1. A floatable assembly comprising a substantially rigid support pole having upper and lower ends, a stabilizing weight affixed directly to the lower end of said pole, a float loosely surrounding said pole, a pivot member carried by said pole intermediate the ends of the pole and contacting a central region of said float for providing a universal pivotal connection between said float and said pole whereby said float is permitted to tilt under wave action while said pole remains substantially upright and a useful article connected to the upper end of said pole.

2. The assembly of claim 1, further comprising means for limiting movement of said float relative to said pole.

3. The assembly of claim 1, further characterized in that said useful article is a sunshade and a beverage tray is mounted on said pole above said float.

4. The assembly of claim 1, further comprising means for adjusting the length of said pole between said stabilizing weight and said universal pivotal connection.

5. The assembly of claim 1, further characterized in that said useful article is game apparatus.

6. A floatable sunshade assembly comprising a generally upright, substantially rigid support pole having upper and lower ends, a sunshaded mounted on the upper end of said pole, a stabilizing weight affixed to the lower end of said pole, a beverage tray mounted stationary on said pole intermediate the ends of the pole, and a float loosely surrounding said pole beneath said beverage tray, said beverage tray having a semi-spherical projection on its lower surface surrounding said pole for contacting said float and permitting universal movement of the float relative the pole.

7. The sunshade assembly of claim 6, further comprising means for limiting movement of said float relative to said pole.

8. The sunshade assembly of claim 6, further characterized in that said float has a cruciform configuration in plan to facilitate access to said tray.

9. The sunshade assembly of claim 6, further comprising means for adjusting the distance between the weight and the float.

10. The sunshade assembly of claim 6, further characterized in that said pole has an axis and means are provided for adjusting the position of the weight in relation of the axis of the pole.

* * * * *